US006213463B1

(12) United States Patent
Eberle et al.

(10) Patent No.: US 6,213,463 B1
(45) Date of Patent: Apr. 10, 2001

(54) CONVEYING APPARATUS FOR FLEXIBLE, FLAT ARTICLES ARISING IN AN IMBRICATED FORMATION

(75) Inventors: Jürg Eberle, Hinwil; Willy Leu, Pfäffikon, both of (CH)

(73) Assignee: Ferag AG, Hinwil (SE)

( * ) Notice: Subject to any disclaimer, the term of this patent is extended or adjusted under 35 U.S.C. 154(b) by 0 days.

(21) Appl. No.: 09/378,668

(22) Filed: Aug. 20, 1999

(30) Foreign Application Priority Data

Sep. 4, 1998 (CH) ..... 1818/98

(51) Int. Cl.[7] ..... B65H 29/04

(52) U.S. Cl. ..... 271/205; 271/151; 271/216; 198/470.1; 198/475.1; 198/478.1

(58) Field of Search ..... 271/184, 189, 271/190, 192, 205, 82, 314, 151, 216; 198/460.3, 470.1, 475.1, 478.1

(56) References Cited

U.S. PATENT DOCUMENTS 3,877,564 4/1975 Reist ..... 198/103
4,320,894 3/1982 Reist et al. ..... 271/277
4,512,457 4/1985 Reist et al. ..... 198/479
4,896,874 * 1/1990 Müller ..... 271/186

* cited by examiner

*Primary Examiner*—Christopher P. Ellis
*Assistant Examiner*—Khoi H. Tran
(74) *Attorney, Agent, or Firm*—Brinks Hofer Gilson & Lione

(57) ABSTRACT

The conveying apparatus has a transport belt (10) which is intended to feed flexible, flat articles (12) arising in imbricated formation (S), resting freely, to a conveyor (14). The transport belt (10) is led around a deflection drum (16) and, together with the latter, forms a deflection and conveying gap (26) for the imbricated formation (S). On one side, an edge section (21) of said imbricated formation projects beyond the deflection drum (16). The circulation path (104) of the conveyor (14) runs alongside the drum. Said conveyor is equipped with grippers (20) which are intended to grip the deflected imbricated formation (S) in the edge section and to transport it further.

20 Claims, 2 Drawing Sheets

CONVEYING APPARATUS FOR FLEXIBLE, FLAT ARTICLES ARISING IN AN IMBRICATED FORMATION

BACKGROUND OF THE INVENTION

The present invention relates to conveying apparatuses for flexible, flat articles arising in an imbricated formation according to the preamble to claims 1 and 10.

Conveying apparatuses of this type are disclosed by Swiss Patent No. 559692 and by the corresponding U.S. Pat. No. 3,877,564. A continuously revolving driven conveying mechanism has a roller chain and endless rubber sections fitted to both ends of the link pins of this roller chain. These sections form a support for the imbricated stream to be transported. At the start and at the end of the transport section, the conveying mechanism is led around sprockets. Fastened to the chain at a distance one after another are guide carriages which are led between the sprockets in hollow rails. From each of the guide carriages, there extend, to either side, a sleeve-like gripper outrigger to whose free ends movable gripper jaws are hinged. Fixed jaws arranged on the gripper outrigger, and the movable jaws, are intended to grip the imbricated formation at the two lateral channel sections. A transport belt is intended to feed the imbricated formation, resting freely, to the conveyor, the conveying mechanism coming to bear on the free flat side of the imbricated formation in the region of the sprocket. Connected directly downstream of the transport belt is a further conveying mechanism, which is designed in the manner of a chain-roller belt, driven so as to circulate and, together with the conveying mechanism deflected around the sprocket, forms a conveying and deflection gap for the imbricated formation. In the region of the conveying gap, the relevant grippers are then closed to transport the imbricated formation further. At the end of the conveying section, the transfer to a further transport belt is designed symmetrically in relation to the equipment at the start of the conveying section. In the deflection around the sprocket at the start and at the end of the conveying section, the endless conveying mechanism itself forms the support for the imbricated formation. Said mechanism must therefore be driven in the region of the sprockets and also between the latter at the same speed as the transport belts and, in addition, the grippers must clamp the products firmly in the plane of the conveying mechanism in order to avoid damage to the articles. The known conveying apparatus needs a considerable amount of space, in particular in the region of the deflection, and places close limits on the construction of the conveyor.

BRIEF SUMMARY OF THE INVENTION

It is, therefore, an object of the present invention to provide a generic conveying apparatus which, with a small space requirement, permits a great deal of flexibility in the construction of the conveyor.

This object is achieved with a generic conveying apparatus. Deflection takes place around a drum which is separate from the circulation path of the grippers. In the region of the deflection, it is thus possible for the grippers to have a different speed from that of the imbricated formation; the conveyor having the grippers is not tied to the deflection which permits different embodiments of the conveyor. The conveying apparatus can thus be adapted in a simple way to the most diverse requirements.

The invention will be described in more detail using an exemplary embodiment illustrated in the drawing, in which, in purely schematic form:

DETAILED DESCRIPTION OF THE INVENTION

Figure 1:
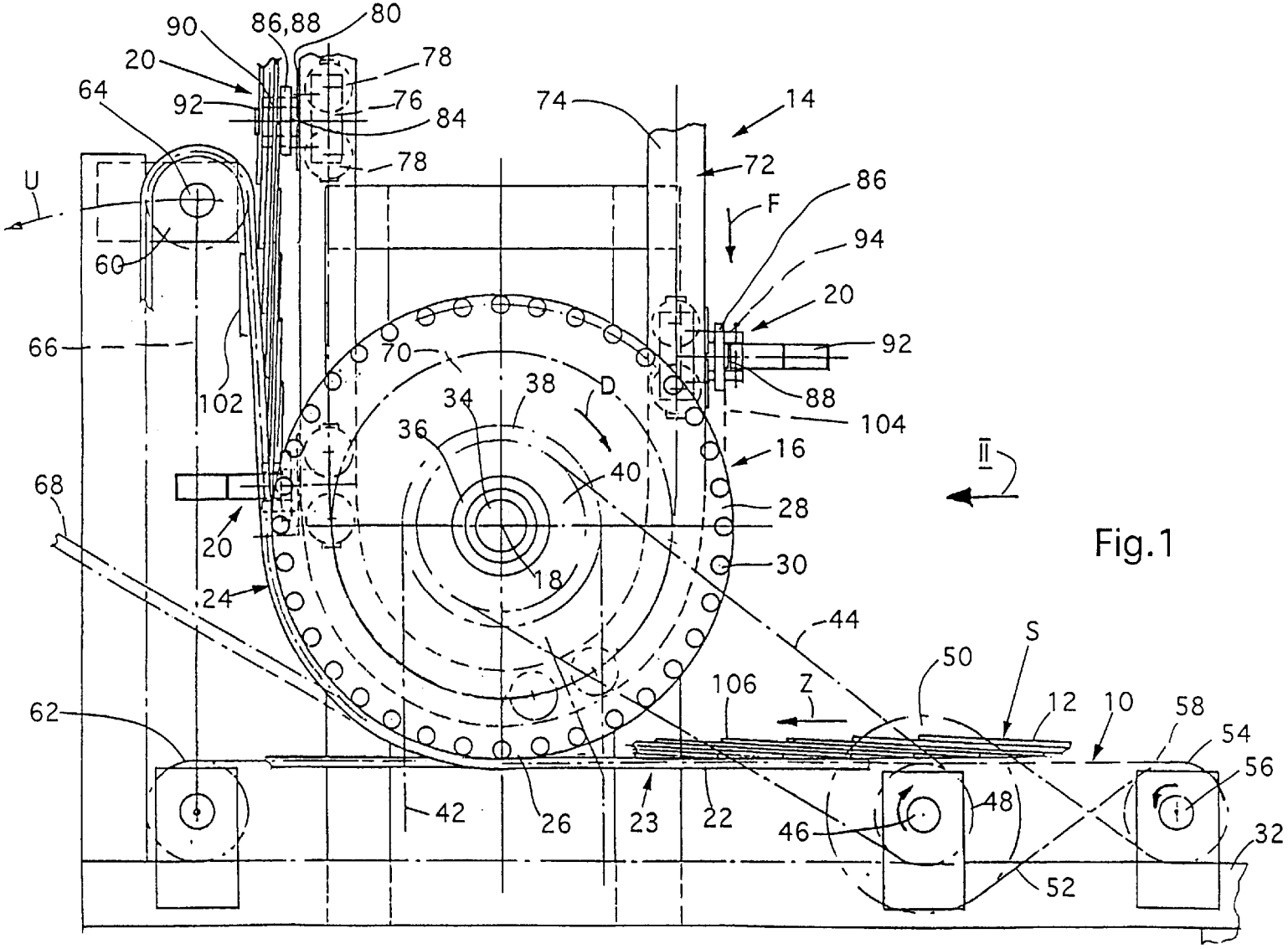
FIG. 1 shows a side view of part of a conveying apparatus.

The conveying apparatus has a transport belt 10 which is driven in the feed direction Z and which is intended to feed articles 12 arranged in an imbricated formation S—in the present case printed products, such as newspapers, magazines or parts thereof—resting freely to a conveyor 14 connected downstream. Arranged above the transport belt 10 is a deflection drum 16 whose axis of rotation 18 runs in the horizontal direction and at right angles to the feed direction Z. The transport belt 10 runs tangentially up to the deflection drum 16 and wraps around the latter by approximately 90°. As viewed in the feed direction Z, the conveyor 14, which is equipped with controllable grippers 20, runs laterally alongside the deflection drum 16. Said conveyor is intended to use its grippers 20 to firmly clamp the imbricated formation S deflected around the deflection drum 16 in a lateral edge section 21 and to transport it further in the conveying direction F, see in particular FIG. 2.

In the example shown, the transport belt 10 is formed by seven tapes 22 arranged beside one another in the manner of a tape conveyor 23. Five of these tapes, as viewed in the direction of the axis of rotation 18, are located in the region of the deflection drum 16, engage around the underside of said drum and drive it. The remaining two tapes 22 are located outside the region of the deflection drum 16 underneath the conveyor 14. The five tapes 22 led around the deflection drum 16 form a driven conveying mechanism 24 which, together with the deflection drum 16, bounds a deflection and conveying gap 26 for the imbricated formation S.

The deflection drum 16 has a circular disk-shaped plate 28 along whose periphery uniformly distributed rods 30 running parallel to the axis of rotation 18 are fastened. Said rods all project from the plate 28 on that side facing away from the conveyor 14 and form a drum-like deflection cage which is open on its side opposite the plate 28. A drive shaft 34 which is coaxial with the axis of rotation 18 and is mounted on a machine frame 32 passes freely through the center of the plate 28. In the interior of the deflection drum 16, a bearing element 36 is seated on the drive shaft 34, is connected on one side to the latter by a frictional connection and to the front of which, on the other side, the plate 28 is fastened. The bearing element 36 acts with the drive shaft 34 in the manner of a loose drive, for example via a frictional connection, in order to carry along the deflection drum 16 in the direction of rotation D of the drive shaft 34. However, it should be mentioned that the deflection drum 16 can also be mounted such that it rotates freely.

On the end region of the drive shaft 34 that faces away from the deflection drum 16, a sprocket 38 and an output drive wheel 40 are rotationally fixedly seated on said shaft. A drive chain 42, which is driven in the direction of rotation D by a drive motor (not shown), engages around the sprocket 38.

Via a drive belt 44, the output drive wheel 40 drives a drive wheel 48 arranged on an intermediate shaft 46. The intermediate shaft 46 runs in the feed direction Z, upstream of the deflection drum 16, in the direction at right angles to the feed direction Z, between the runs of the tapes 22. Arranged on said intermediate shaft is an intermediate wheel 50 which is rotationally fixedly connected to the drive wheel 48 and is connected to a further drive wheel 54 by a drive belt 52 which is crossed so as to run with a reversal of the direction of rotation. Said drive wheel 54 is rotationally fixedly seated on a drive shaft 56, on which, at the upstream end of the transport belt 10, the deflection wheels 58 for the tapes 22 are keyed. The five tapes 22 whose active run engages around the deflection drum 16 run upward from the deflection drum 16 in an approximately vertical direction and are led around freely rotatably mounted upper deflection wheels 60. From the latter, the return run runs downward in the vertical direction to lower deflection wheels 62, from where it runs back to the further drive wheels 54. The lower deflection wheels 62 are freely rotatably mounted on an axle arranged on the machine frame 32. Also mounted on this axle are the downstream deflection wheels 62 for the two tapes 22 arranged laterally outside the deflection drum 16.

The upper deflection wheels 60 are freely rotatably mounted on an axle 64, which is arranged on a pivoting lever 66. The latter is pivotably mounted on the machine frame 32, adjacent to the axle of the lower deflection wheels 62, and can be moved in the direction of the arrow U from a deflection position, shown by continuous lines in FIG. 1, into a passage position 68, in which, as indicated by dash-dotted lines in FIG. 1, the active run of the transport belt 10 no longer engages around the deflection drum 16, or only to a much lower extent. As a result, the conveying apparatus can be used in the manner of a diverter, for example, for separating out rejects.

Between the deflection drum 16 and the sprocket 38, a cam wheel 70 is rotationally fixedly seated on the drive shaft 34. Engaging around said cam wheel 70 is a guide rail 72 of C-shaped cross section, which has a clothoid shape in the region of the cam wheel 70. In the region of the cam wheel 70, the base connecting the side legs 74 of the guide rail 72 is penetrated so that the cam wheel 70 can engage in the interior of the guide rail 72 which is open to the outside in the radial direction.

Arranged one behind another in the guide rail 72 are carrying elements 76, which, on one side, are guided via guide wheels 78 in the interior of the guide rail 72 and on the other side are guided by means of further guide wheels 80 on the mutually facing ends of the side legs 74 which are bent toward each other. On the side which is opposite the guide wheels 80 and thus faces the cam wheel 70, the carrying elements 76 have tooth-like projections and depressions which are intended to interact with identically shaped teeth on the cam wheel 70. The carrying elements 76 are thus driven in the region of the deflection by means of the cam wheel 70. Downstream of the cam wheel 70, the drive takes place in a jerky manner because of the carrying elements 76 resting on one another at their ends. A gripper 20 is arranged at each nth, for example fourth, carrying element 76. For this purpose, a support 84, from which an outrigger 86 running at right angles to the conveying direction F projects, is seated on the axles for the guide wheels 80. A fixed gripper tongue 88 is arranged on said outrigger on that side which faces away from the support 84 and thus from the carrying element 76, and is free in the direction of the outside. This tongue may be provided with a frictional covering.

On that end of the outrigger 86 which faces away from the deflection drum 16 there is seated a gripper housing 90, on which a corrugated, spring-like, movable gripper tongue 92 is mounted about a pivot axis 94 running in the conveying direction F. A hold-open spring 96, which is likewise fastened to the gripper housing 90 and is designed in the manner of a leaf spring, acts on the movable gripper tongue 92 in the direction of opening of the latter, so that when it is opened, it is arranged approximately at right angles to the fixed gripper tongue 88. The pivot axis 94, to which the movable gripper tongue 92 is fastened at one end, is connected in the interior of the gripper housing 90 to a closing lever 98 which is mounted on the latter. Freely rotatably mounted on said lever 98, at its free end, is a control roller 100, which is intended to interact with a fixed closing striker 102 in order to move the movable gripper tongue 92 from the open position into the closed position. Also arranged in the gripper housing 90 is a latching element of a generally known type, in order to latch the pivot axis 94 moved into the closed position. In order to release the movable gripper tongue 92, this latch can likewise be unlocked in a generally known way, for example by means of an opening striker.

The guide rail 72 defines a movement track for the grippers 20, said track being separate from the deflection drum 16. As viewed in the conveying direction F, the movement track runs in the direction from top to bottom toward the deflection drum 16, then around the cam wheel 70 and the drive shaft 34 and, approximately parallel to that section of the tapes 22 which runs downstream of the deflection drum 16, in the direction from bottom to top. The guide rail 72 is designed in such a way that the circulation path 104, along which the gripper tongues 88 are moved, bears from the inside on the imbricated formation S, laterally alongside the deflection drum 16, in the region of the deflection of the imbricated formation S around the deflection drum 16. For this purpose, the edge section 21 of the imbricated formation S, as can be seen from FIG. 2, projects beyond the deflection drum 16 on the side facing the conveyor 14. This edge section 21 is supported by the two tapes 22 running rectilinearly past the deflection drum 16.

The peripheral speed of the cam wheel 70 and thus the speed of the carrying elements 76 and grippers 20 is selected such that, in a section of the guide rail 72 which runs rectilinearly, these move at least approximately at the circulation speed of the transport belt 10 and thus of the tapes 22. In the example shown, the grippers 20 thus move, in the region of the deflection drum 16, with a higher speed than the imbricated formation S, but on the other hand these two speeds are at least approximately identical downstream of the deflection drum 16. The closing striker 102 begins to act at the downstream end of the deflection and conveying gap 26. In any case, the grippers 20 are closed before the articles 12 to be gripped and held by the latter have left the deflection and conveying gap 26.

The apparatus shown in the figures functions as follows. The articles 12 arising in imbricated formation S, which rest freely on the transport belt 10, come to bear on the deflection drum 16 with their free flat side 106 which faces away from the transport belt 10, and are deflected in the upward direction in the shortest space in the deflection and conveying gap 26. In the region of this deflection, at specific intervals, in each case the fixed gripper tongues 88 of the grippers 20 come to bear on the imbricated formation S in the edge section 21 on the radially inner flat side. At the downstream end of the deflection and conveying gap 26, or shortly thereafter, the gripper 20 is closed by the movable gripper tongue 92 being pivoted into the closed position, so that it grips the imbricated formation S in the lateral edge section 21 and holds it firmly for further transport.

The distance between successive grippers 20 is preferably selected in such a way that it is slightly smaller than the length, measured in the conveying direction, of the articles 12 to be transported, so that each article 12 in the imbricated formation S is held by at least one of the grippers 20. In a preferred way, by selecting the distance between successive grippers 20, it is ensured that none of the articles 12 is held by three or more grippers 20. This makes it possible to transport the imbricated formation S around curves which are located in the surface of the imbricated formation S.

The cage-like design of the deflection drum 16 makes it possible for the radially inner parts of the articles 12, the radially inner sheets in the case of newspapers or magazines, to escape in a wave shape between the rods 30 in the region of the deflection. This embodiment ensures non-damaging deflection of the articles 12, with the smallest space requirement. A further contribution to this is made by the loose drive for the deflection drum 16. Forces which run in the peripheral direction and which could have an influence on the articles are at least approximately avoided. It is of course possible for the deflection drum 16 also to be designed with a closed outer surface. This is particularly the case when thin articles with a relatively small mutual overlap are to be transported.

In principle, it is also conceivable to drive the grippers 20 in such a way that their speed is lower in a rectilinear section of the guide rail 72 downstream of the cam wheel 70 than the speed of the tapes 22 and of the deflection drum 16. This leads to the situation in which the articles 12 held firmly by a gripper 20 are bent in a wave shape between this gripper and the downstream end of the deflection and conveying gap 26, the peaks and valleys of the wave running at right angles to the conveying direction F. This makes it possible to transport the articles 12 without damage around curves transverse to the surface of the imbricated formation S.

Figure 2:
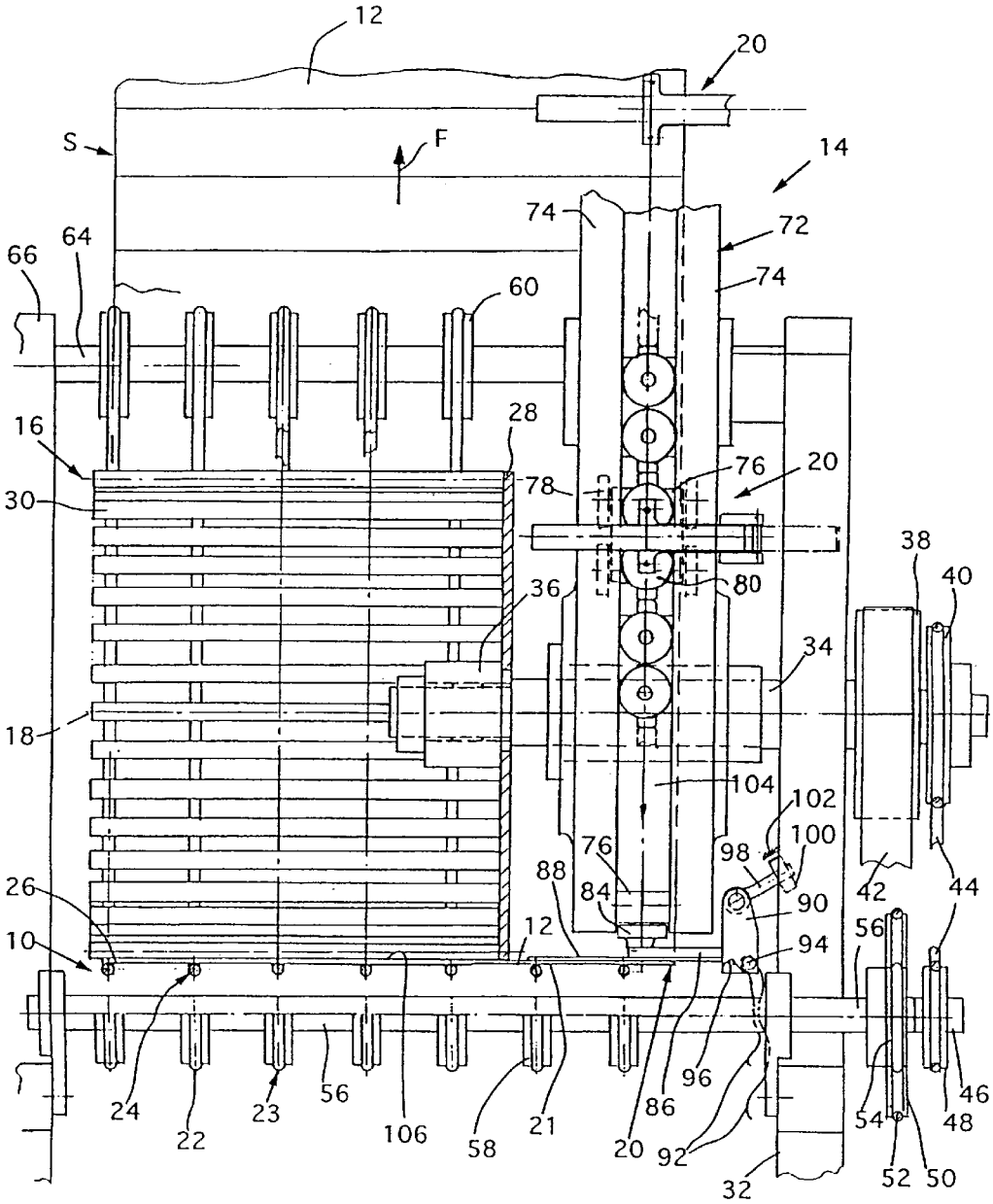
FIG. 2 shows, in the view in the direction of the arrow II in FIG. 1 and partly sectioned, the same part of the conveying apparatus.

The conveying apparatus can be designed to be exactly the same at the end of the conveying section as is shown, using FIGS. 1 and 2, at the start of the conveying section. The only difference is that the conveying direction F and the direction of rotation D are reversed, and the direction in which the transport belt 10 carries articles away is opposite to the feed direction Z. Furthermore, instead of the closing striker 102, there is an opening striker to open the grippers 20.

It is of course also conceivable to design the conveyor 14 differently. As a result, because of its independence of the deflection drum 16, the widest possible range of options is provided.

In the example shown, the deflection and conveying gap runs around the deflection drum 16 through about 90°. This wrap angle may be selected to be greater or smaller. This permits simple adaptation to the physical conditions.

The deflection drum 16 may be freely rotatably mounted on the drive shaft 34.

What is claimed is:

1. A conveying apparatus for flexible, flat articles, such as printed products, arriving in an imbricated formation, said imbricated formation having a flat side (106) and a lateral edge section (21), comprising:

a transport belt (10) for feeding the imbricated formation (S); a conveyor (14) having a circulation path (104) that functions to move the imbricated formation in a conveying direction (F), said conveyor (14) being arranged downstream of the transport belt (10), said conveyor (14) having grippers (20) which are arranged one behind another and are controlled to grip said lateral edge section (21) of the imbricated formation (S);

deflection means, that bears on said flat side (106) of the fed imbricated formation (S), comprising a deflection drum (16);

a driven conveying mechanism (24), said driven conveying mechanism (24) forms with said deflection drum (16) a conveying and deflection gap (26) for the imbricated formation (S) and engages around said deflection drum (16);

said lateral edge section (21) of the imbricated formation projects beyond said deflection drum (16) and said circulation path (104) is independent of said deflection drum (16) such that the grippers (20) are free to move laterally past the deflection drum (16) on the side where said lateral edge section (21) projects from the deflection drum (16).

2. The conveying apparatus as claimed in claim 1, wherein the transport belt (10) functions to convey the imbricated formation (S) resting freely thereon, the deflection drum (16) bears on said flat side (106) of the imbricated formation (S) which faces away from the transport belt (10), and the conveying mechanism (24) engages around the underside of the deflection drum (16).

3. The conveying apparatus as claimed in claim 2, wherein the conveying mechanism (24) imparts drive to the deflection drum.

4. The conveying apparatus as claimed in claim 1, wherein the deflection drum (16) includes a plate (28) that is mounted for rotation about an axis of rotation (18), a plurality of rods (30) carried by said plate (28), said rods extending parallel to said axis of rotation (18) to form a cage with plate (28).

5. The conveying apparatus as claimed in claim 1, wherein the conveying mechanism (24) and the transport belt (10) are formed by a single belt conveyor (23) that is comprised of multiple belts, belts (22) running around the deflection drum (16) and additional belts (22) located beyond the deflection drum (16) as viewed in the direction of its axis of rotation (18), said additional belts adapted to support said lateral edge section (21) of the imbricated formation (S), said additional belts run rectilinearly past the deflection drum (16).

6. The conveying apparatus as claimed in claim 1, wherein, downstream of the deflection drum (16), the conveying mechanism (24) is led around a deflection wheel (60), which can be moved from a deflection position, in which the conveying mechanism (24) runs around the deflection drum (16), into a passage position (68), in which the conveying mechanism (24) runs mainly rectilinearly past the deflection drum (16).

7. The conveying apparatus as claimed in claim 1, wherein the circulation path (104) of the grippers (20) when adjacent the deflection drum (16), as measured in the radial direction from the axis of rotation (18) of the deflection drum (16), runs inside the conveying path of the imbricated formation (S).

8. The conveying apparatus as claimed in claim 1, wherein the conveyor (14) includes a guide channel (72), in which carrying elements (76) are movably guided in the conveying direction (F), and the grippers (20) are carried on elements (76).

9. The conveying apparatus as claimed in claim 8, wherein said guide channel (72) runs around the axis of rotation (18) of the deflection drum (16).

10. The conveying apparatus as claimed in claim 1, wherein the deflection drum (16) is carried by a drive shaft (34), a drive wheel (70) of the conveyor (14) is carried by said drive shaft 34.

11. A conveying apparatus for flexible, flat articles, such as printed products, arriving in an imbricated formation and to be conveyed in a conveying direction (F), said imbricated formation having a flat side (106) and a lateral edge section (21), comprising:

a conveyor (14) for feeding the imbricated formation (S), said conveyor (14) including grippers (20) which are arranged one behind another to move along a circulation path (104), said grippers (20) being controlled to grip a lateral edge section (21) of the imbricated formation (S);

a transport belt (10), said transport belt (10) being arranged downstream of said conveyor (14), and functions to lead the imbricated formation (S) away in the conveying direction (F);

a deflection mechanism that bears on said flat side (106) of the fed imbricated formation (S), said deflection mechanism including a deflection drum (16);

a driven conveying mechanism (24) forming with said deflection mechanism a conveying and deflection gap (26), and engaging around said deflection drum (16);

said lateral edge section (21) of said imbricated formation (S) projects beyond said deflection drum (16), said circulation path (104) being independent of said deflection drum (16) such that the grippers (20) are free to move laterally past the deflection drum (16) along the side of the lateral edge section (21).

12. The conveying apparatus as claimed in claim 11, wherein the transport belt (10) functions to convey the imbricated formation (S) resting freely thereon, the deflection drum (16) bears on said flat side (106) of the imbricated formation (S) which faces away from the transport belt (10), and the conveying mechanism (24) engages around the underside of the deflection drum (16).

13. The conveying apparatus as claimed in claim 12, wherein the conveying mechanism (24) imparts drive to the deflection drum.

14. The conveying apparatus as claimed in claim 11, wherein the deflection drum (16) includes a plate (28) that is mounted for rotation about an axis of rotation (18), a plurality of rods (30) carried by said plate (28), said rods extending parallel to said axis of rotation (18) to form a cage with plate (28).

15. The conveying apparatus as claimed in claim 11, wherein the conveying mechanism (24) and the transport belt (10) are formed by a single belt conveyor (23) that is comprised of multiple belts, belts (22) running around the deflection drum (16) and additional belts (22) located beyond the deflection drum (16) as viewed in the direction of its axis of rotation (18), said additional belts adapted to support said lateral edge section (21) of the imbricated formation (S), said additional belts run rectilinearly past the deflection drum (16).

16. The conveying apparatus as claimed in claim 11, wherein, downstream of the deflection drum (16), the conveying mechanism (24) is led around a deflection wheel (60), which can be moved from a deflection position, in which the conveying mechanism (24) runs around the deflection drum (16), into a passage position (68), in which the conveying mechanism (24) runs mainly rectilinearly past the deflection drum (16).

17. The conveying apparatus as claimed in claim 11, wherein the circulation path (104) of the grippers (20) when adjacent the deflection drum (16), as measured in the radial direction from the axis of rotation (18) of the deflection drum (16), runs inside the conveying path of the imbricated formation (S).

18. The conveying apparatus as claimed in claim 17, wherein the conveyor (14) includes a guide channel (72), in which carrying elements (76) are movably guided in the conveying direction (F), and the grippers (20) are carried on said carrying elements (76).

19. The conveying apparatus as claimed in claim 18, wherein said guide channel (72) runs around the axis of rotation (18) of the deflection drum (16).

20. The conveying apparatus as claimed in claim 11, wherein the deflection drum (16) is carried by a drive shaft (34), a drive wheel (70) of the conveyor (14) is carried by said drive shaft 34.

* * * * *